US005393153A

United States Patent [19]

Bouthillier et al.

[11] Patent Number: 5,393,153

[45] Date of Patent: Feb. 28, 1995

[54] TOOTHPASTE DISPENSER

[75] Inventors: Roch-Jean Bouthillier; Cécile Beaudoin, both of Montréal; Antonio Diaz, La Minerve, all of Canada

[73] Assignee: Corporation Roch-Jean Bouthillier et Fils Inc., Montreal, Canada

[21] Appl. No.: 159,558

[22] Filed: Dec. 1, 1993

[51] Int. Cl.[6] ..... A46B 11/02

[52] U.S. Cl. ..... 401/146; 401/149; 401/150; 401/180; 401/188 R

[58] Field of Search ..... 401/146, 149, 150, 180, 401/188 R

[56] References Cited

U.S. PATENT DOCUMENTS

| | | | |
|---|---|---|---|
| 1,602,823 | 10/1926 | Kole | 401/180 X |
| 2,652,949 | 9/1953 | Martin | 401/180 X |
| 3,738,761 | 6/1973 | Hard . | |
| 4,068,974 | 1/1978 | Meyer et al. | 401/150 |
| 4,787,765 | 11/1988 | Kuo | 401/146 X |

FOREIGN PATENT DOCUMENTS

| | | | |
|---|---|---|---|
| 214328 | 2/1957 | Austria | 401/188 |
| 353161 | 9/1935 | Canada . | |
| 459665 | 12/1945 | Canada | 401/180 |
| 123518 | 10/1984 | European Pat. Off. | 401/149 |
| 2438443 | 6/1980 | France | 401/149 |
| 2600513 | 12/1987 | France | 401/188 |
| 3514600 | 8/1986 | Germany | 401/150 |

*Primary Examiner*—Steven A. Bratlie

*Attorney, Agent, or Firm*—Pierre Lespérance; Francois Martineau

[57] ABSTRACT

An automatic feed fluid dispenser comprising: a reservoir cylinder, for enclosing and containing fluid, the reservoir defining an inlet port and an outlet port; an elongated hollow shank, defining opposite inner and outer ends, each inner and outer ends defining a corresponding mouth, the outer end destined to carry transverse bristles; the reservoir outlet port and the shank member inner end mouth being interconnected; an elongated channel freely extends through the hollow shank and defines opposite first and second ends, the first end extending through the hollow shank inner end mouth and into the reservoir, the second end adapted to come in register with the shank outer end mouth; a valve is provided, for releasably closing the shank outer end mouth. An inflated balloon, or a spring-biased piston, continuously biases the fluid through the channel and toward the shank outer end mouth.

1 Claim, 4 Drawing Sheets

141
184
147a
147
T
122
146
144
V
154
150
158a
164
126
158
160a
140
B
128a 138
154
216
161
164
208
202a
202b
210
126a 204
206
212
200
156
202
140b
220
214

132
140
230
240
130
128a 4
4
6
6
36
38
22
52
48
42
44
46
56
50
26
66
54
60
61
62
28
40
36a
70
74
22
T
64
64
56
40
58
60a
34
28
B
32
B'
40a
30
28a
B
B
32
28a
41a
72
72a
41
36a
74
70
22
72
70

TOOTHPASTE DISPENSER

FIELD OF THE INVENTION

This invention relates to automatic toothbrush-like toothpaste dispensers.

BACKGROUND OF THE INVENTION

U.S. Pat. No. 3,738,761 issued Jun. 12, 1973 to Goran HARD AF SEGERSTAD, discloses an automatic toothpaste dispenser in the form of a toothbrush member. The toothbrush member includes an elongated shank 2 having a first outer end 7, bearing transverse bristles 16, and a second inner end 18, having external screwing threads 4. A hollow cylindrical reservoir 20 is threadingly engaged at a first inner end (having internal screwing threads 19) with the external screwing threads 4 of the shank 2, and is closed at its second outer end (also having internal screwing threads 21) by a removable screw plug 23. The elongated shank 2 includes a through-channel 10, opening at one end into the reservoir 20 at the opposite end within the bristles 16. In operation, as the toothpaste-containing reservoir 20 is screwed inwardly along the threaded shank 3, the toothpaste is concurrently forced to engage the channel 10 and to eventually escape through aperture 15 in between the bristles 16. Thus, the biasing force that bias the toothpaste within the bristles is a piston-type biasing means.

Canadian patent No. 353,161 issued Sep. 24, 1935 to C. Alson, consists of a similar device, but further includes a spring-loaded push-valve button, 28, which controls the flow of fluid through the through-channel 16 of the shank 15. By actuating such valve means against the integral spring loaded means thereof, the fluid inside the reservoir 10 is allowed to flow through channel 16 to escape between the bristles 25 under biasing means. Such biasing means are gravity-borne forces (the user has to incline the dispenser with the bristle head located at the lower end thereof).

Therefore, in the patent references, a first means is required to bias the toothpaste through the shank channel, and a second valve means is required to control the flow of fluid through the channel, the first and second means operating independently.

OBJECT OF THE INVENTION

The object of the invention is to simplify toothpaste dispensers by providing such a toothpaste dispenser whereby the toothpaste biasing means is of the automatic type whereby release of the valve means automatically engages the toothpaste dispenser to flow within the bristles.

SUMMARY OF THE INVENTION

Accordingly with the object of the invention, there is disclosed a feed fluid dispenser comprising: (a) a reservoir member, having an enclosure for containing an incompressible fluid, said reservoir member defining an outlet port; (b) an elongated hollow shank member, defining opposite inner and outer ends, each said inner and outer ends defining a corresponding mouth, said outer end destined to carry transverse bristles proximate said shank member outer end mouth; (c) a channel member, freely extending through said hollow shank member and defining an elongated body having opposite first and second open ends; (d) securing means, for releasably interconnecting said reservoir member outlet port to said shank member inner end mouth, whereby said channel member first end extends through said hollow shank member inner end mouth and into said reservoir member while said channel member second end comes in register with said shank member outer end mouth; (e) valve control means, for displacing said channel member through said shank member between a first position, in which said channel member body abuttingly seals said shank member outer end mouth, and a second position, in which said channel member body clears said shank member outer end mouth, for enabling free fluid flow between said channel member and said shank member outer end mouth; and (f) continuously-acting fluid biasing means, for continuously biasing said fluid through said channel member and toward said shank outer end mouth.

Preferably, said continuously-acting fluid biasing means consists of an inflatable elastic bag, lodged within said reservoir member, said inflatable bag containing a second fluid, said second fluid being compressible and reaching positive pressure levels upon said reservoir member being substantially filled with the first mentioned fluid.

Advantageously, said reservoir member includes an aperture opening to ambient air, said inflatable bag including a soft-bodied nipple projecting therefrom and through said reservoir member aperture; pressurized air being adapted to be fed through said soft-bodied nipple and into said inflatable bag.

Profitably, said valve control means includes a spring-loaded knob member, said knob member integrally being carried by said channel member and transversely projecting from said channel member exteriorly of said shank member through the latter; said knob member, under its spring bias, biasing said channel member within said hollow shank member towards said first position thereof, whereby upon actuating said knob member against said spring bias thereof, said channel member is displaced within said shank member to said second position thereof. Said continuously-acting fluid biasing means would preferably consist of a suction pump assembly, said suction pump assembly cooperating with said knob member, whereby step feeding of the fluid from said reservoir member to said shank member outer end is achieved via reciprocating motion of said knob member. Said securing means could then include a coupling member, releasably interlocking said shank member and said reservoir member, said coupling member including an axial sleeve member releasably engaged by said channel member first end for free fluid flow communication between said reservoir member and said channel member through said coupling member, said sleeve member circumscribing an elongated main chamber coaxial with said channel member, said knob member including a knob extension member slidingly extending within a first portion of said elongated chamber exclusively of a second portion of said elongated chamber, said knob extension member having a through passageway defining first and second co-extensive subchambers, a first spring-biased ball valve being mounted within said first subchamber and continuously engaging said channel member inner end, a second spring-biased ball valve being mounted within said main chamber second portion and continuously engaging said knob extension member; wherein said first and second ball valves are releasable against their spring bias in alternating fashion, responsively to differential pressure loads therein being associated with said reciprocating motion of knob member. Said sleeve member could also further define an elongated inner end section, extending deeply within said reservoir member generally coaxially to said channel member.

It is also envisioned that said continuously-acting fluid biasing means includes a piston-like member, slidingly mounted within said reservoir member in a fluid-tight fashion, whereby said reservoir member is divided into first and second opposite compartments; said channel member opening into said first compartment and the latter compartment to contain the first-mentioned incompressible fluid; said second compartment containing a second fluid, said second fluid being compressible and being brought to positive pressure levels whereby said piston-like member is biased toward said channel member.

Preferably, said continuously-acting fluid biasing means includes a piston-like member, slidingly mounted within said reservoir member, whereby said reservoir member is divided into first and second opposite compartments; said channel member opening into said first compartment and the latter compartment to contain the first-mentioned incompressible fluid; said second compartment containing a spring member biasing said piston-like member toward said channel member. In that case, it would be advantageous to add cocking means, to load said spring member in a fully cocked fashion, wherein said cocking means includes manual latch means for release of said cocking means; said latch means being freely accessible from the outside of and extending through and beyond an aperture made in said reservoir member, before release of the cocking means, but, upon such release of said cocking means, becoming completely concealed within said reservoir member and completely inaccessible from the outside thereof.

BRIEF DESCRIPTION OF THE DRAWINGS

FIG. 4*d*, on the fourth sheet of drawings, is a view similar to FIG. 4, but representing a fourth embodiment of the invention;

FIGS. 14 and 14*a* are enlarged views of the intermediate portion-of the fourth embodiment of toothbrush assembly illustrated in. FIG. 4*d*, sequentially suggesting how the reciprocating action of the push-knob enables toothpaste feed into and through the toothbrush shank channel member; and FIG. 15 is an enlarged view of part of the left hand side portion of the toothbrush shank illustrated in FIG. 4*d*, but showing the channel member in its retracted condition corresponding to the operating knob depressed condition illustrated in FIG. 14, whereby the toothpaste outlet ports at the base of the bristles become cleared for free passage of the fluid toothpaste.

DETAILED DESCRIPTION OF THE DRAWINGS

Figure 2:
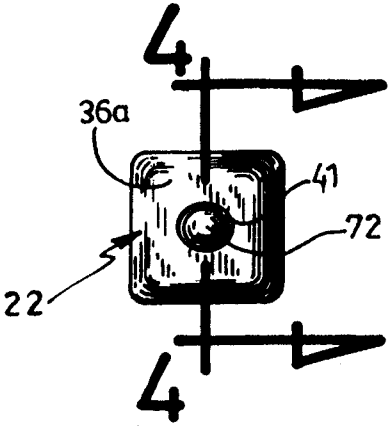
FIG. 2 is an aft end view of the toothbrush assembly.
Figure 1:
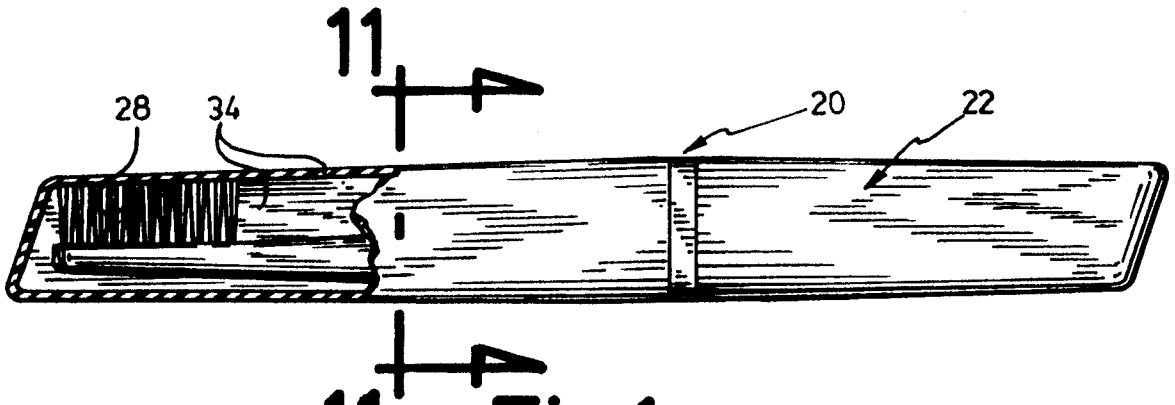
FIG. 1 is a partly sectional plan view of the toothbrush assembly, being fitted with its bristle cover.
Figure 3:
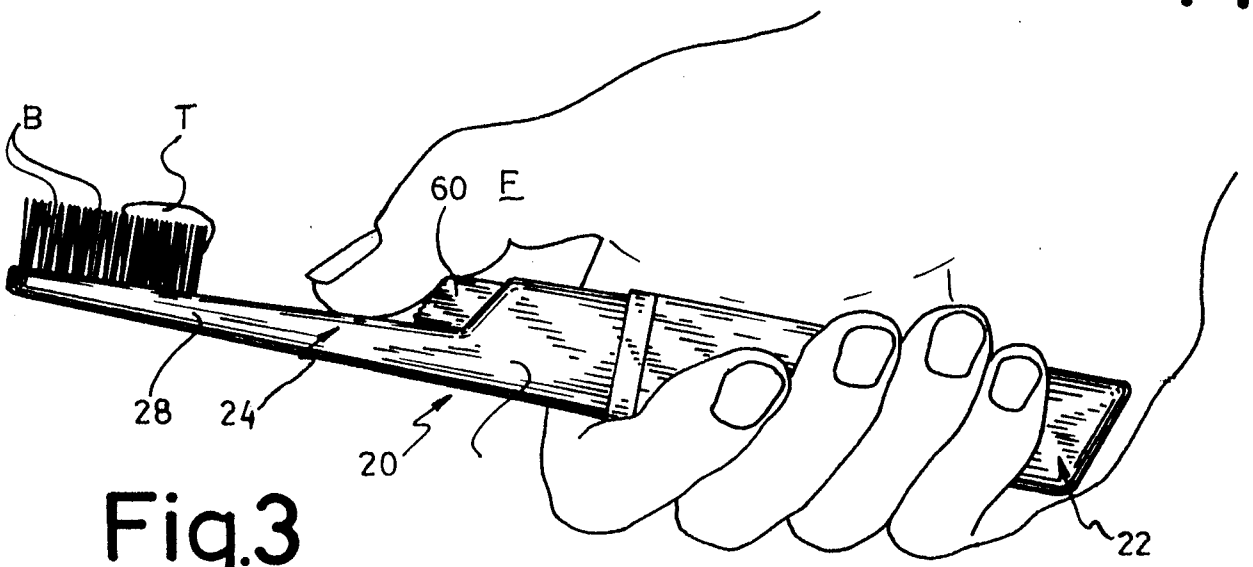
FIG. 3 is a view similar to FIG. 1, but with the bristle cover being removed and suggesting how the operating knob thereof can be actuated by the thumb of a user's hand.

The toothbrush assembly illustrated in FIGS. 1 and 3, at 20, includes an elongated handle 22 and an elongated shank 24 being endwisely interconnected at their respective inner end portions. Handle 22 is for example quadrangular in cross-section (see FIG. 2). Shank 24 defines a short inner portion 26, being slightly smaller diametrally relative to the body of handle 22, and an elongated outer portion 28, diametrally much smaller than inner portion 26. The free tip portion 28*a* (FIG. 5) of the shank outer portion 28 is generally full and destined to carry transverse bristles B (not forming part of the invention as such). The remaining part of the shank outer portion 28 is hollow, thus defining an axial channel 30. Channel 30 extends slightly beyond the proximal bristle tufts B'. A bore 32 is made transversely of channel 30, proximate to but spaced from the full shank portion 28*a*, this bore 32 opening exteriorly of the shank and destined to open within the proximal bristles B'.

The shank 24, including the bristles B, is destined to be covered by a removable cover 34, (FIG. 1), of a diametral shape similar to that of handle 22, whereby a unitary-like smooth toothbrush assembly is achieved when the cover is set against shank 24.

Elongated handle 22 defines a rigid body 36 enclosing an inner reservoir 38, for containing a fluid, e.g. toothpaste T or the like fluid material, be it thixotropic or not in nature. Reservoir body 36 defines a small aperture 41 at its (free) distal end, and a larger aperture 42 at its opposite proximal end. It is understood that toothpaste T in reservoir 38 is in fluid communication with the toothpaste outlet port 32, via aperture 42 and the shank axial channel 30. Closure means (detailed later) are destined to seal the distal aperture 41 of reservoir body 36, while fluid biasing means (also detailed later for a number of different embodiments of the invention) will bias toothpaste T from reservoir 38 through large aperture or mouth 42.

According to the invention, an elongated tubular member 40 is axially engaged into channel 30, and should be of a dimension enabling free axial displacement of the tubular member 40. Tubular member 40 should be at least as long as channel 30, and preferably diametrally tapering toward full end 28*a*. A coupler 44 is provided, to secure by friction fit the inner shank portion 26 to the reservoir body 36 about the aperture 42. More particularly, coupler 44 includes a flat wall 46, which closes aperture 42, from which transversely projects a first annular lip 48, frictionally engaging the inner portion of the interior face of reservoir body 36, and an opposite, second, diametrally smaller annular lip 50, frictionally engaging the inner portion of the interior face of shank portion 26. A bore 52 is made into coupler wall 46, in register with channel 30 and of a dimension corresponding to the external diameter of the inner end portion of tubular member or tube 40. A sleeve member 54 integrally mounted transversely to wall 46 and coextensively to bore 52, projects axially into the hollow of shank portion 26. The inner end portion of tube 40 frictionally engages into the sleeve 54. An elastomeric O-ring 56 is engaged around tube 40 within sleeve 54, to seal the joint therebetween, whereby toothpaste T inside reservoir 38 becomes in fluid communication with tube 40 exclusively of channel 30.

Axial displacement of tube 40 through channel 30 is enabled by a roughly L-shape knob member, 58, which projects transversely from an intermediate section of tube 40 in register with shank portion 26. L-shape knob 58 defines an axial leg 60 and a transverse leg 61 integral to tube 40. Leg portion 60 of knob 58 is preferably knurled at its free surface, 60*a*, and projects outwardly from shank portion 26 through an axial aperture 62 made in the offset formed between large and small shank portions 26 and 28, respectively.

Figure 4A:
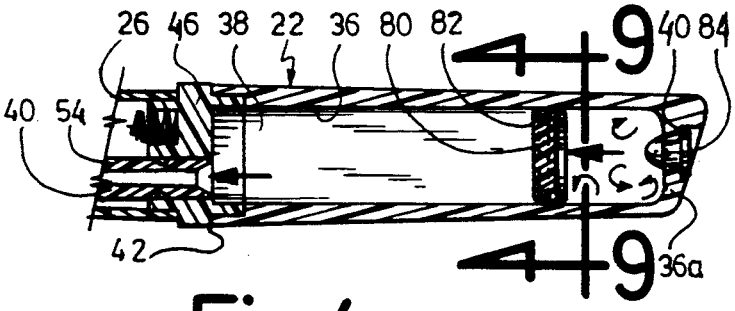
FIGS. 4*a* and 4*b*, on the third sheet of drawings, are views similar to that of the right-hand side portion of FIG. 4, but representing a second and a third embodiment respectively of the invention.
Figure 4B:
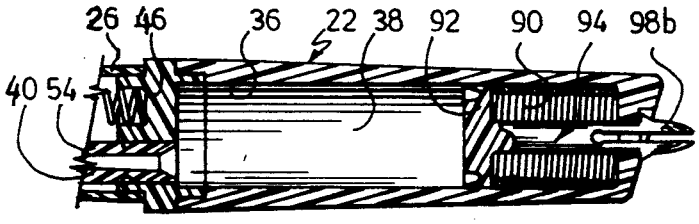
Figure 4C:
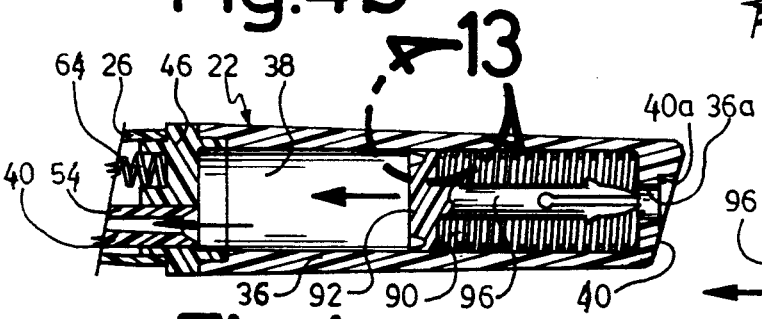
FIG. 4*c* is a view similar to FIG. 4*b* for the same embodiment of the invention, but with the spring-loaded piston being shown in an extended condition relative to its position in FIG. 4*b;*
Figures 4D, 14, 14A, 15:
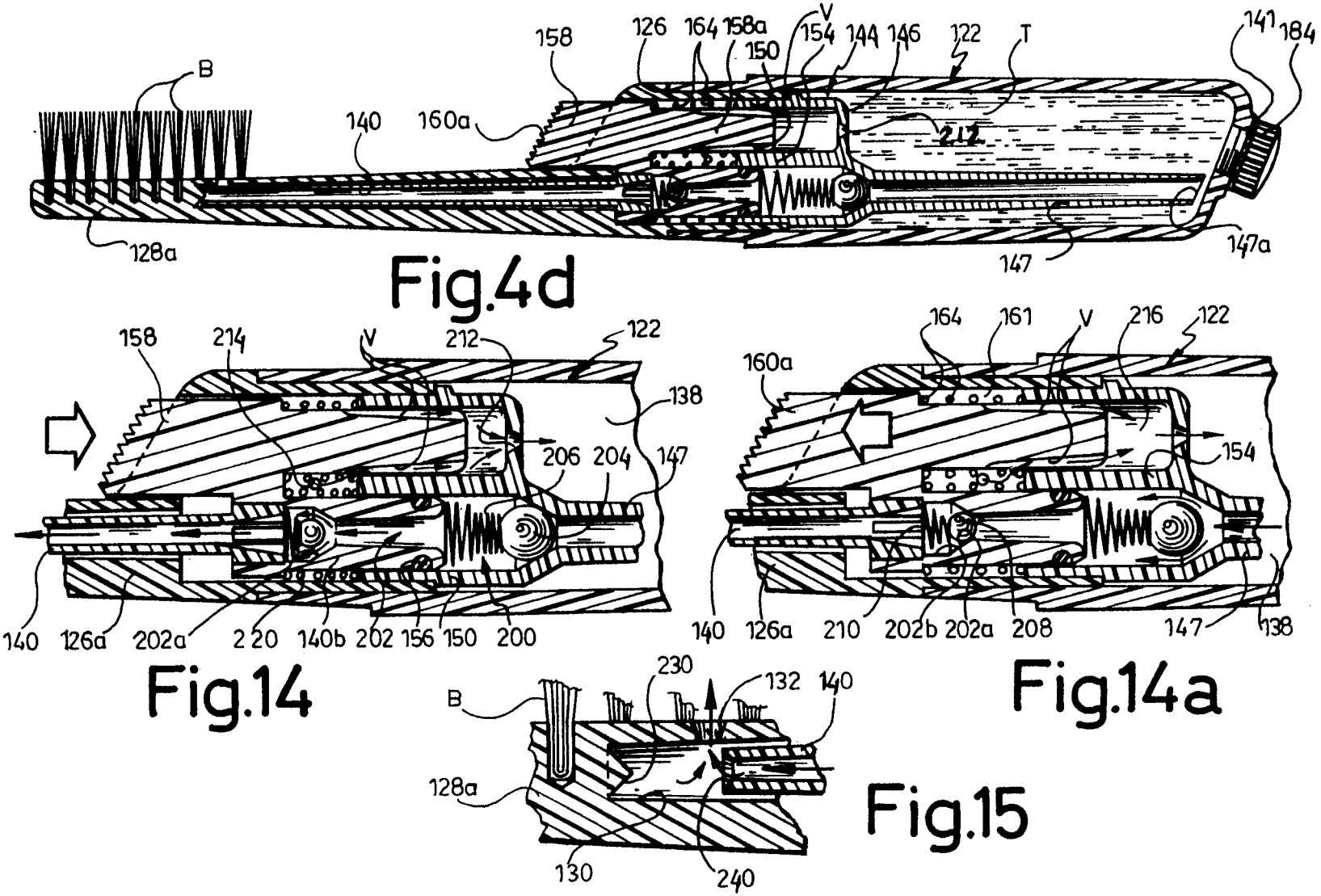
Figures 4, 5, 6, 7, 8:
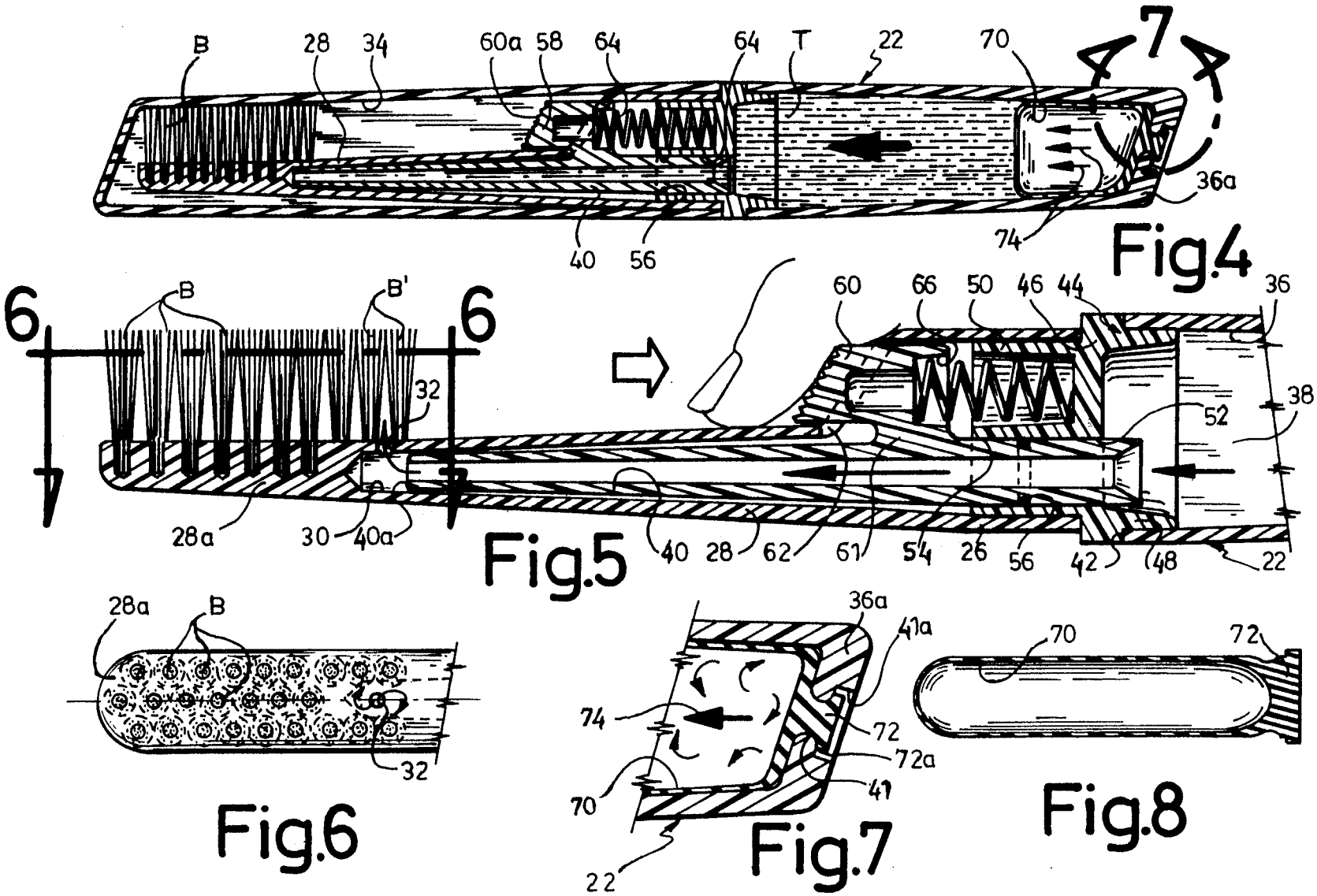
FIG. 4 is a sectional view along line 4—4 of FIG. 2, illustrating a first embodiment of the invention.
FIG. 5, on the second sheet of drawings, is an enlarged view of the left-hand side portion of FIG. 4, but with the bristle cover being removed and the operating knob being operated as generally suggested in FIG. 3.
FIG. 6 is a plan view across the bristles of the inner face of the toothbrush shank, as taken about lines 6—6 of FIG. 5.
FIG. 7 is an enlarged view of the area circumscribed by circle 7 in FIG. 4.
FIG. 8 is a view similar to the right-hand side portion of FIG. 4, but with the inflated flexible bag being much expanded upon the toothbrush cylindrical reservoir having become emptied of the fluid toothpaste.

As clearly seen in the sequence of FIGS. 4 and 5, biasing means, preferably a coil spring 64, biases knob 58 in the extended condition illustrated in FIG. 4, whereby transverse leg 61 comes to sidewisely abut against the inner end of shank portion 28 circumscribing aperture 62. More specifically, knob member 58 includes a cavity 66 in axial register with and opposite to the free knurled face 60*a*, for receiving and containing the distal end of coil spring 64, while the proximal (inner) end of knob 58 seats flatly against the coupler main wall 46.

As suggested in FIGS. 4–5, sleeve 54 generally supports spring 64 to maintain the latter in axial alignment with knob leg 60, i.e. parallel to tube 40.

At rest position, tube 40 is biased by spring 64 to move to the retracted limit position illustrated in FIG. 4, where its outer free bevelled end 40*a* abuts against the conical end of channel 30 which is located beyond fluid outlet port 32. Thus, toothpaste T engaging tube 40 cannot escape through outlet port 32. As the knurled surface 60*a* of knob 60 is depressed by a user's finger F, against the bias of coil spring 64, tube 40 concurrently moves axially through channel 30, away from the shank portion 28*a*, thus clearing outlet port 32, and into reservoir 38, with rubber O-ring 56 ensuring a sealed engagement between tube 40 and sleeve 54; toothpaste T from reservoir 38 is therefore able to flow through tube 40, through mouth 40*a*, into the inner end portion of channel 30, whereby upon build-up of toothpaste being generated in channel 30, overflow through outlet port 32 and within bristles B' will occur, as generally suggested in FIG. 3.

The heart of the invention lies in the biasing means which biases in a continuingly-acting fashion the toothpaste located inside the reservoir 38 to engage into tube 40 toward bristles B. A first embodiment of such biasing means is illustrated in FIGS. 4, 7 and 8. Such fluid biasing means simply consists of an inflatable flexible well bag 70, located within reservoir 38 and applied against the free end 36*a* of reservoir body 36. Bag 70 includes a projecting nipple 72, sealingly engaging through the small aperture 41 of body 36 and defining a free nipple enlargement 72*a* engaging in a seating fashion an annular cavity 41*a* made on the exterior face of wall 36*a*. A compressible fluid, e.g. air, is fed into elastic bag 70, to extend it to its condition illustrated in FIG. 8, thus occupying at least a substantial portion of the inner volume of reservoir 36, until steady state equilibrium is achieved.

To fill reservoir 38 with toothpaste T, coupler 46 is forcibly withdrawn from body 36, and toothpaste T is freely poured into reservoir 38 through aperture 42. Inflatable bag 70 is completely deflated. Then, coupler 46 is installed in operative position within mouth 42. Bag 70 may thus become partially or totally flattened (not illustrated) against wall 36*a* by the load of toothpaste in the reservoir 38. Then, pressurized air (or the like fluid) is fed into inflatable bag 70, e.g. via a hypodermic-type needle (not illustrated) extending freely through bore 41 and through soft-bodied nipple 72, up to and into the enclosure of elastic bag 70. Since toothpaste T is an incompressible fluid, positive pressure is generated inside bag 70 without a volumic change thereof, as suggested by the multiple arrows 74 in FIGS. 4 and 7. This positive pressure in elastic bag thus biases toothpaste T into tube 40, as suggested by the large bold arrow 76 in FIG. 4. There is no yielding flow of toothpaste into tube 40, in the released condition of knob 58, since the tube end 40*a* closes port 32. As knob 58 is depressed (empty arrow 77 in FIG. 5), toothpaste T will be allowed to flow through cleared outlet port 32. The rate of flow will be greater when reservoir 38 is full or relatively so of toothpaste, since the compressible fluid (e.g. air) inside inflated bag 70 Will be at its highest positive pressure level. Upon the reservoir 38 becoming progressively emptied, the air pressure inside the elastic bag 70 progressively diminishes—i.e. the bias applied against toothpaste T to flow into the tube 40 and to escape through outlet port or bore 32 also progressively decreases, resulting in a lower outflow rate of toothpaste.

Figure 9:
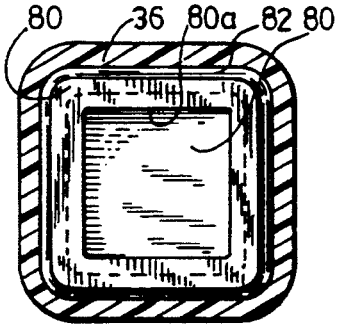
FIG. 9 is an enlarged cross-section taken about lines 9—9 of FIG. 4*a;*

In the alternate embodiment of toothpaste outflow biasing means illustrated in FIGS. 4*a* and 9, the inflatable bag is replaced simply by a piston-like slider panel 80, slidable axially within reservoir 38. Panel 80 is made for example from a rigid plastic material. A sealing O-ring 82 is fitted at the periphery of panel 80, and a plug 84 is fitted into bore 41. The distal face of panel 80 (on the side of bore 41)) defines a cavity 80*a*. Again, reservoir 38 is first filled with toothpaste T, and coupler 46 is thereafter installed in position at 42, whereby panel 80 becomes partly or fully applied against wall 36*a*. Cavity 80*a* enables panel 80 to clear the inwardly projecting section of plug 84 when panel 80 becomes applied against wall 36*a*, and also defines an air pocket for build up of air pressure when pressurized air is fed in the volume located between slider panel 80 and end wall 36*a* (e.g. by the same hypodermic-type needle extending through soft body plug 84). An overpressure bias loading of approximately 8 to 12 pounds per square inch is envisioned to be sufficient, when the selected fluid inside the reservoir 22 is toothpaste.

In the third—and preferred—embodiment of toothpaste biasing means, illustrated in FIGS. 4b–4c, 10–1a, and 11–13, the pressurized air is simply replaced by an elongated coil spring 90, axially extending between and seated at its opposite ends against a slider panel 92 at its inner end and against the reservoir body end wall 36a at its outer end. Slider panel 92 is sized to frictionally engage body 36, but no sealing O-ring nor plug for bore 41 is required since no positive pressure build-up is involved. Preferably, there is further provided a releasable, elongated anchor member, 94, for anchoring slider panel 92 spacedly to end wall 36a. Anchor member 94 consists of a main elongated shaft 96, with one end portion integral at 96a axially to panel 92, and with the other end portion 96b extendable freely through bore 41. Shaft 96 extends axially through the coils of coil spring 90.

The shaft outer free end portion 96b defines a pair of barbed tines 98a, 98b. Tines 98a, 98b are pretensioned in a parallel fashion relative to one another, but, as suggested in FIG. 10a, may be forcibly moved against one another, i.e. against their inherent spring bias, to close the gap or slit 99 therebetween.

In the fully compressed condition of coil spring 90, illustrated in FIG. 4b, the tines 98a, 98b extend beyond end wall bore 41, with the barbs 100a, 100b of tines 98a, 98b, respectively, engaging the floor of cavity 41a. Hence, barbs 100a, 100b, lock slider panel 92 in its cocked condition, against the extensional bias of compressed coil spring 90. Now, upon the tines 98a, 98b, being forcibly brought against one another, e.g. by two fingers F of a user's hand—FIG. 10—(this is possible since the tips of the tines escape outwardly from the handle 22 through bore 41 and thus are accessible to the user), barbs 100a, 100b will release the floor of cavity 41a, thus enabling free ingress of the tines free barbed end through bore 41 and into reservoir 38 (FIG. 4c).

In operation, the volume of reservoir 38 located between walls 46 and 92 is destined to receive and contain (together with the inner volume of tube 40) toothpaste. During storage, transport and shelve time of the product, the coil spring 90 is desirably maintained in cocked condition by the tine barbs 100a, 100b, engaging the cavity floor 41a of end wall 36a. This locking in the cocked condition is advantageous in that it constitutes a tamper-evident means, i.e. a clue to alert the consumer that a third party has tampered with the toothpaste before the purchase. It is understood that once barbs 100a–100b are released, the tines 98a, 98b, move completely inside reservoir 36 and are therefore completely out of manual (outside) reach, thus precluding a would be tampering party from concealing his wrongful action. Such locked cocked condition is also advantageous in that it substantially reduces the likelihood of accidental leakage. Moreover, the useful lifetime of the toothpaste dispenser is arguably extended.

Figure 10:
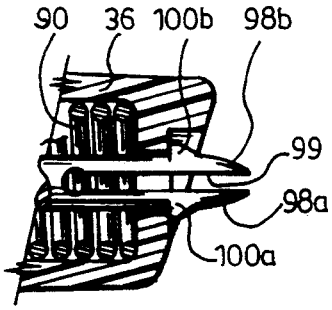
FIGS. 10 and 10*a* are enlarged views' of the right-hand side portions of FIGS. 4*b* and 4*c*, respectively.
Figure 10A:
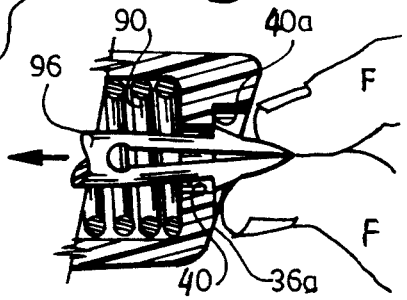
Figure 13:
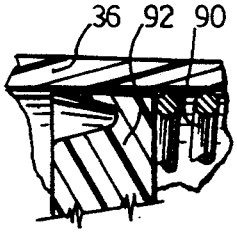
FIG. 13 is an enlarged view of the area circumscribed by ellipse 13 in FIG. 4*c;*
Figure 11:
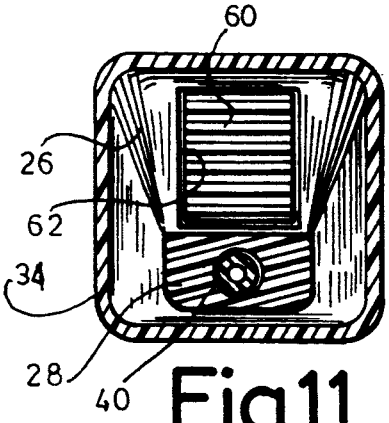
FIG. 11 is a cross-section at an enlarged scale, taken about line 11—11 of FIG. 1.
Figure 12:
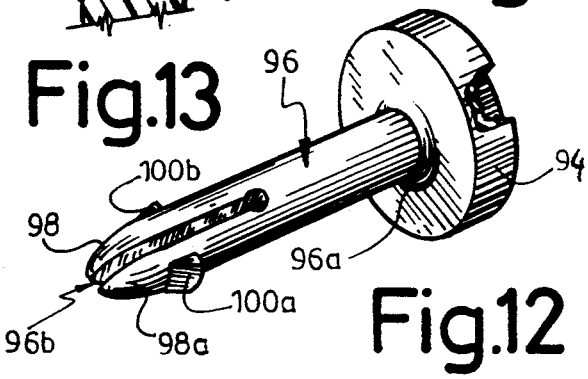
FIG. 12 is a perspective view of the piston member forming part of the third embodiment of the invention as illustrated in operation in FIGS. 4*b* and 4*c;*

Upon a consumer purchasing this dispenser, he is instructed on the packaging label to release the tines prior to use (which project from bore 41 axially away from wall 36a)—see FIG. 10—by drawing the tips of tines 98a, 98b toward one another (FIG. 10a). This in turn generates pressure against the toothpaste T in reservoir 38, which will be yieldingly released within bristles B upon button 60 being depressed (FIG. 3).

The fourth and last embodiment of toothpaste biasing means is illustrated in FIGS. 4d, 14–14a and 15. This embodiment differs substantially from the first three embodiments, but the overall basic inventive ideal remains the same. In this fourth embodiment, no moving part is enclosed within the toothpaste reservoir proper, 138. As in the first three embodiments, the outer end of tube 140 acts as a valve to close discharge opening 132, its undercut frusto-conical end 240 sealingly fitted against the protruding conical end 230 of channel 130.

Depressing knob 158 displaces tube 140 axially through channel 130 to open the valve. However, coupler 146 further defines an integral, elongated, tubular member 147, extending deep into toothpaste reservoir 138 with its open mouth 147a located slightly short of end wall bore 141 and coaxial to first tubular member 140. Bore 141 is threaded and closable by a screw cap 184.

Central knob 158 includes an inward projecting leg 158a, extending deep into the well formed by walls 150 and 154 of the coupler 146, projection 158a being generally parallel to coaxial tubes 140. The knob projecting leg 158a being slightly thinner than the knob knurled portion 160a, an annular gap 161 is formed therearound (relative inter alia to the body of shank portion 126). Coil spring 164 is now lodged into this gap 161, to bias—as in the other embodiments—the knob 158 in its outwardly extended condition illustrated in FIG. 4.

In this fourth and last embodiment of dispenser, the heart of the invention lies inside the enlarged chamber 200 located midway between coaxial tubes 140 and 147, as generally illustrated in FIGS. 14 and 14a. Chamber 200 is formed of the lower portion of coupler lips 150 and of the coupler intermediate (axial) wall 154, together with the portion 140b of tube 140 (integral to knob 158) engaging the corresponding portion of chamber 200. Thus, tube portion 140b defines a second chamber 202 inside the main chamber 200. Chamber 200 narrows toward the inner end of diametrally smaller tube 147, about a first funnel shape portion 200a, while chamber 202 includes a subchamber 202b that widens towards the juncture between the tube 140 and its inner portion 140b, about a second funnel shape portion 202a. The first and second funnel portions being on opposite sides of chamber 200. A large spherical ball valve 204 is located within chamber 200, and biased against the first funnel portion 200a by a coil spring 206, coil spring 206 bearing on its opposite end against the free inner end of tube inner section 140b.

A second, smaller, spherical ball valve 208 is located within subchamber 202b and biased against the second funnel portion 202a by a coil spring 210. It is understood that spring 210 biases ball valve 208 to seal chamber 202, while spring 206 biases ball valve 204 to seal chamber 200. Moreover, both springs 206 and 210 bias their corresponding ball valves 204, 208, in the same direction, i.e. toward tube 147.

Wall 146 of coupler 144 includes a bore 212, as illustrated in FIGS. 14–14d, which communicates the reservoir 138 with an inlet port 214 made in shank portion 126, through coextensive air passage channels V made in projection 158a of knob 158, to enable ambient air intake into reservoir 138 as the same is being emptied of toothpaste T.

In operation, the toothpaste dispenser works as a suction pump. As suggested by the multiple arrows in FIG. 14, upon firstly depressing knob 158 into shank portion 126, knob extension (or "piston") 158a comes to bias air inside pocket 216 to enter into toothpaste reservoir 138. This in turn promotes circulation of toothpaste T from reservoir 138, through mouth 147*a* and into tube 147, to eventually reach leading ball valve 204.

Moreover, since sleeve 140*b* circumscribing chamber 202 is integral to knob 158, sleeve 140*b* moves into main chamber 200 toward and abuttingly against ball valve 204, via spring 206, thus compressing air inside chamber 200. Ball valve 208 responsively moves away from funnel seat 202*a*, to reestablish steady-state pressure differential by enabling the compressed air inside chamber 200 to escape into tube 140.

Then, secondly, as knob 158 is released (FIG. 4*a*), spring 164 biases knob 158 to its outwardly extended condition, thus moving sleeve 140*b* against ball valve 208 whereby subchamber 202*b* becomes sealed. Since a negative pressure develops once again inside chamber 200, ball valve 204 moves away from funnel seat 200*a*, to allow toothpaste T to flow from tube 147 into chamber 200 (see the arrows in FIG. 14*a*). Toothpaste T builds up into chambers 200 and 202, but cannot escape through subchamber 202*b* and into tube 140 because coil spring 164 biases sleeve 140*b* to abut against the inner end of tube 140, to the limit condition illustrated in FIG. 4*d*, whereby ball valve 208 is concurrently forced against funnel outlet 202*a* thus sealing same. (O-ring 156 provides seal-tight engagement between sleeve 140*b* and coupler walls 150 and 154)

Now, thirdly, as the knob 158 is depressed once again (FIG. 14), the toothpaste T that got trapped inside chambers 200 and 202 becomes able to escape through subchamber 202*b* and into tube 140, much in the same way as discussed for positive air pressure release during the first step discussed hereinabove.

Preferably, a coil spring 220 is provided around the end portion of sleeve 140*b*, in register with ball valve 208, partly within a cavity of knob 158, to afford a better balance of parallel motion between knob 158 and sleeve 140*b*.

It is understood that, due to the shape and orientation of tube 147, toothpaste T will easily flow therein in a natural way, upon a gravity-filling reservoir 138 with toothpaste in the natural fashion, i.e. by orienting the dispenser so that the intake port 141 be located at the top thereof and so that the bristle-carrying end be at the bottom end thereof. It is also understood that the (preferred) conicity of bore 212 provides for air circulation therethrough exclusively of toothpaste flow, thus precluding undesirable backflow of toothpaste T inside chamber 216.

We claim:

1. A feed fluid dispenser comprising:

(a) a reservoir member, having an enclosure for containing toothpaste;

(b) an elongated hollow shank member, integrally mounted to said reservoir member and defining an inner end located within said enclosure and a free outer end, a through-passage being defined along said hollow shank member with an inner mouth at said inner end thereof and a toothpaste outlet port at said outer end thereof;

(c) a channel member, slidingly extending through the hollow of said shank member and defining an elongated body having opposite inner and outer end portions and a narrowed internal diameter section located intermediate the inner and outer ends thereof, said channel member inner and outer end portions defining opposite end mouths of a through-passage; said channel member being slidable between a first position, in which said channel member outer end portion closes said shank member outlet port, and a second position, in which said channel member outer end portion clears said shank member outlet port and brings said shank member outlet port in fluid communication with said channel member through-passage;

(d) a tubular member defining an elongated body having opposite inner and outer open end portions and a narrowed internal diameter section located intermediate the inner and outer end portions thereof, said tubular member inner end portion being slidingly engaged by said channel member inner end portion and said tubular member outer end portion being freely located within said enclosure and forming a toothpaste intake port;

(e) valve control means, for displacing said channel member body from said first to said second positions thereof for controlling fluid flow between said channel member through-passage passage and said shank member outlet port, and including: a double spring-biased valve assembly, for step feeding volumic loads of the toothpaste to said toothpaste outlet port, said valve assembly including first and second valve members, mounted into said channel member and into said tubular member respectively within a common area forming a suction pumping pressure chamber, and first and second spring-biasing members, each fixedly carried by said channel member and directly and continuously engaging with said first and second valve members respectively and biasing said first and second valve members against first and second shoulders respectively formed by said intermediate narrowed internal diameter sections of said channel member and said tubular member, respectively, whereby both said channel member and said tubular member intermediate narrowed internal diameter sections are normally closed by said first and second valve members respectively, the biasing force of said first and second spring-biasing members being both directed toward said tubular member toothpaste intake port; and (f) continuously-acting fluid biasing means, for continuously biasing said toothpaste from said reservoir member enclosure toward said toothpaste outlet port;

wherein said first spring-biasing member and associated said first valve member are of a smaller size than that of said second spring-biasing member and associated said second valve member, the biasing force of both of said spring-biasing members being such that each said valve member remains responsive at different fluid pressures developed within said pressure chamber and induced by said fluid biasing means, upon reciprocating motion of said channel member between said first and second positions thereof, against the bias of said spring-biasing members.

* * * * *